United States Patent [19]

Bennon et al.

[11] 3,967,226

[45] June 29, 1976

[54] ELECTRICAL INDUCTIVE APPARATUS HAVING MAGNETIC SHIELDING CORES AND A GAPPED MAIN CORE STRUCTURE

[75] Inventors: Saul Bennon; William D. Albright, both of Muncie, Ind.

[73] Assignee: Westinghouse Electric Corporation, Pittsburgh, Pa.

[22] Filed: June 10, 1975

[21] Appl. No.: 585,730

[52] U.S. Cl. ..... 336/84; 336/92; 336/212; 336/215

[51] Int. Cl.[2] ..... H01F 15/04

[58] Field of Search ..... 336/84, 212, 214, 215, 336/211, 92

[56] References Cited

UNITED STATES PATENTS 2,780,786 2/1957 Johnson ..... 336/212

3,571,772 3/1971 Bennon et al. ..... 336/215

*Primary Examiner*—Thomas J. Kozma

*Attorney, Agent, or Firm*—C. L. McHale

[57] ABSTRACT

A magnetic core arrangement for shell-form power transformers. A main core structure is divided into two core portions by a gap which separates the core laminations. Two shielding cores are located on each side of the main core. Double-webbed beams are positioned underneath the main and shielding cores to support these cores from the transformer tank. One web of a beam extends into part of the gap between the main core portions. The other web of the beam is located between the outermost main core portion and one of the shielding cores. The gap in the main core structure improves the cooling of the magnetic laminations and the web members of the beam enhance the support for the core laminations.

2 Claims, 4 Drawing Figures

ELECTRICAL INDUCTIVE APPARATUS HAVING MAGNETIC SHIELDING CORES AND A GAPPED MAIN CORE STRUCTURE

BACKGROUND OF THE INVENTION

1. Field of the Invention:

This invention relates, in general, to electrical inductive apparatus and, more specifically, to single-phase power transformers with magnetic shielding cores.

2. Description of the Prior Art:

Large shell-form power transformers have usually required shields constructed of magnetic laminations located around the transformer tank to prevent excessive heating in the metallic tank members. U.S. Pat. No. 3,821,677, which is assigned to the assignee of this invention, describes a shielding arrangement of this type as applied to a three-phase transformer. Several arrangements have been developed to reduce the heating in the tank walls which do not rely upon the placement of shielding laminations along the tank structure. U.S. Pat. No. 3,571,772, which is assigned to the assignee of this invention, discloses an arrangement wherein shielding magnetic core loops are located on each side of the main magnetic core of a single-phase transformer. The shielding loops not only direct much of the leakage flux away from the tank walls, but also function with the main core to provide a portion of the primary magnetic flux path linking the various windings. This allows some reduction in the size of the magnetic core and of the tank enclosure.

The arrangement disclosed in U.S. Pat. No. 3,571,772 is useful in power transformers having moderately high ratings. However, certain problems arise when the rating of the transformer is extremely high. In very large single-phase transformers, the main magnetic core becomes so thick that proper heat dissipation is difficult to obtain and hot spots near the center of the lamination punchings may develop. In addition, the mere size and weight of the main magnetic core structure is such that conventional supporting arrangements are insufficient to hold the laminations properly.

U.S. Pat. No. 2,780,786 discloses a magnetic core arrangement which uses shielding loops and which has a passageway or duct in the main core for the purpose of ventilating the magnetic core structure. However, the magnetic core arrangement of the transformer disclosed in U.S. Pat. No. 2,780,786 is intended for use with the faces of the magnetic laminations mounted perpendicular to the horizontal mounting surface. With this orientation, the weight of the laminations does not act perpendicular to the lamination faces. Thus, supporting arrangements used for the core of U.S. Pat. No. 2,780,786 are basically different that those used for supporting shell-form magnetic cores wherein the lamination faces are parallel to a horizontal plane.

Therefore, it is desirable, and it is an object of this invention, to provide a shielded shell-form power transformer wherein the magnetic core is constructed to provide adequate cooling for internal core portions and wherein the horizontally oriented laminations are conveniently supported.

SUMMARY OF THE INVENTION

There is disclosed herein a new and useful magnetic core arrangement for shell-form power transformers wherein adequate shielding, cooling and supporting is provided in a novel and unobvious manner. The magnetic core arrangement includes a rectangular main core having two portions which are spaced with a gap therebetween. Two shielding magnetic cores are positioned adjacent to opposite sides of the main core. The laminations of each magnetic core are oriented with their flat faces parallel to the horizontal bottom surface of the transformer tank. One supporting beam is located at the bottom of the stacked laminations which form the main core to provide sufficient support for the laminations. A web portion of the supporting beam is located in part of the gap between the main core portions for the purpose of increasing the ability of the beam to support the laminations. Another web portion of the beam is located between one of the shielding cores and the outermost main core portion. A similar beam structure is located at the end of the main magnetic core which is adjacent to the other shielding core. The gap in the main core allows better cooling of the core laminations than previous core configurations. The gap also provides a region in which the strengthening web members of the beams may be positioned between horizontally oriented laminations to provide sufficient support for the core laminations.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
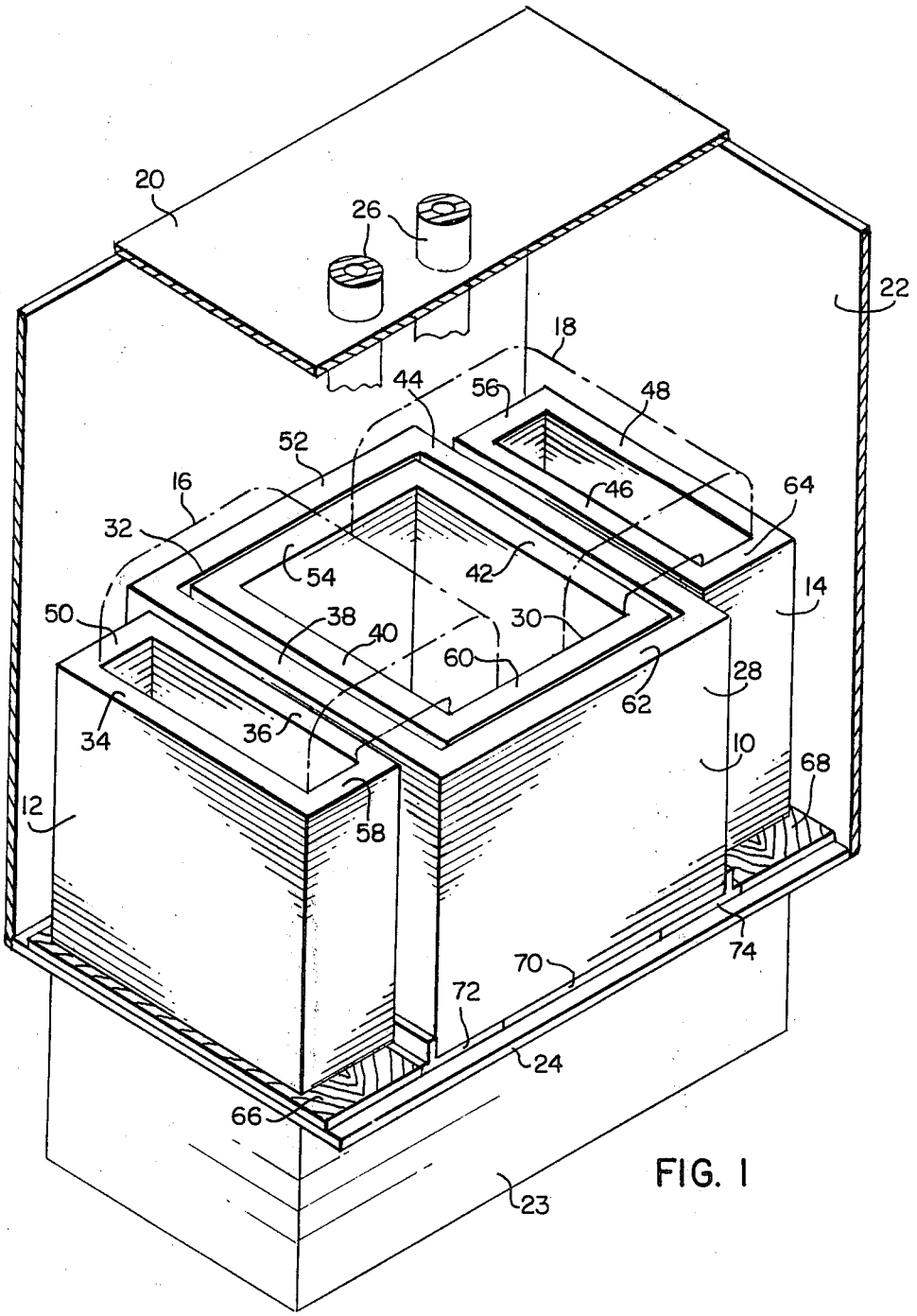
FIG. 1 is a cut-away view of a shell-form power transformer constructed according to the teachings of this invention.

Throughout the following description, similar reference characters refer to similar elements or members in all of the figures of the drawing.

Referring now to the drawing, and to FIG. 1 in particular, there is shown a single-phase, shell-form power transformer constructed according to this invention. The transformer includes the main magnetic core 10 and the two shielding magnetic cores 12 and 14. The magnetic cores 10, 12 and 14 are inductively coupled to the coils 16 and 18 of the winding structure which is illustrated in phantom in FIG. 1. Although other types of coil arrangements may be used, the embodiment disclosed herein illustrates the use of pancake-type coils for the winding structure.

The core and coil assembly is enclosed within a transformer tank 20 which includes side walls, such as the side wall 22, and a bottom portion 23 which includes a horizontal supporting surface 24. The laminations of the magnetic cores are oriented with the planes containing their flat faces perpendicular to the side walls of the transformer tank 20 and parallel to the horizontal supporting surface 24. The supporting surface 24 is used as the lower surface of the tank 20 from which the core and coil assembly is supported. Although not shown in FIG. 1, normally an oil dielectric and cooling fluid is contained within the transformer tank and covers the core and coil assembly. The electrical bushings 26 are illustrative of the bushings which are attached to the transformer tank 20 for the purpose of connecting the winding structure located within the tank 20 to external electrical circuits.

The main magnetic core 10 includes an outer core portion 28 and an inner core portion 30. The inner and outer core portions are separated from each other by a gap 32 which extends around the entire path length of the magnetic core 10. Actually, the magnetic core 10 consists of two separate magnetic cores which are aligned with the same central axis through the core openings but which are located at different radial positions from the central axis. The gap 32 between the main magnetic core portions 28 and 30 allows sufficient cooling of the magnetic laminations to prevent excessive heat buildup near the center of the magnetic core 10 which would be a problem when a large magnetic core is constructed without any sufficient means for allowing the cooling dielectric to flow through the magnetic core laminations. The shielding magnetic cores 12 and 14 are located on each side of the magnetic core 10 and are also constructed of flat laminations which are aligned with their flat surfaces perpendicular to the vertical walls of the transformer tank 20. The magnetic core legs 34, 36, 38, 40, 42, 44, 46 and 48 are oriented substantially parallel to the axes of the coils 16 and 18 and are connected by the magnetic yokes 50, 52, 54, 56, 58, 60, 62 and 64.

The magnetic laminations which form the legs and yoke of the magnetic cores 10, 12 and 14 inherently lack rigidity in the vertical direction due to their dimensions and orientation with respect to the vertical direction. For this reason, it is necessary to support the laminations by a structure or arrangement which keeps the laminations from sagging or deforming under their own weight. The wood spacers 66, 68 and 70 separate the magnetic core laminations from the metallic transformer tank but offer little in the way of overall support for the magnetic core laminations. The supporting beams 72 and 74 rest against the horizontal supporting surface 24 and provide the primary means for maintaining the straightness of the laminations of the magnetic cores.

Figure 2:
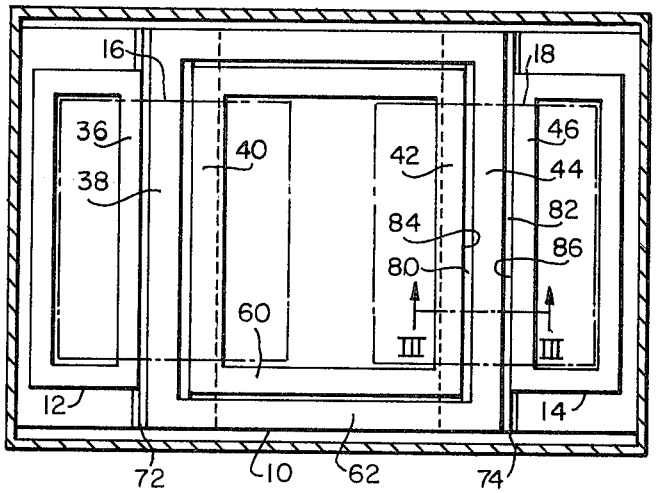
FIG. 2 is a top view of the core and coil assembly shown in FIG. 1.
Figure 3:
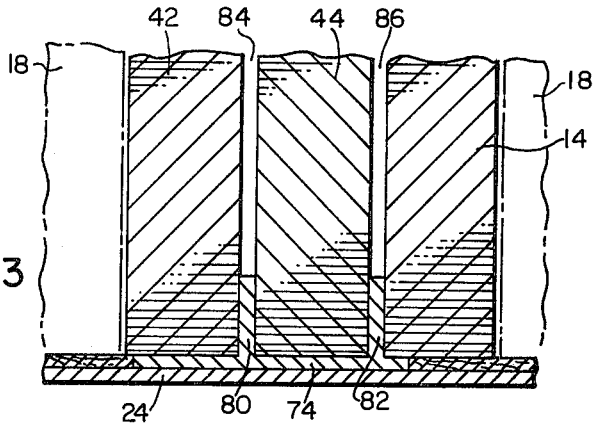
FIg. 3 is a partial cross-sectional view taken generally along the line III—III of FIG. 2; and, FIG. 4 is a view of a supporting beam for use with a power transformer constructed according to this invention.
Figure 4:
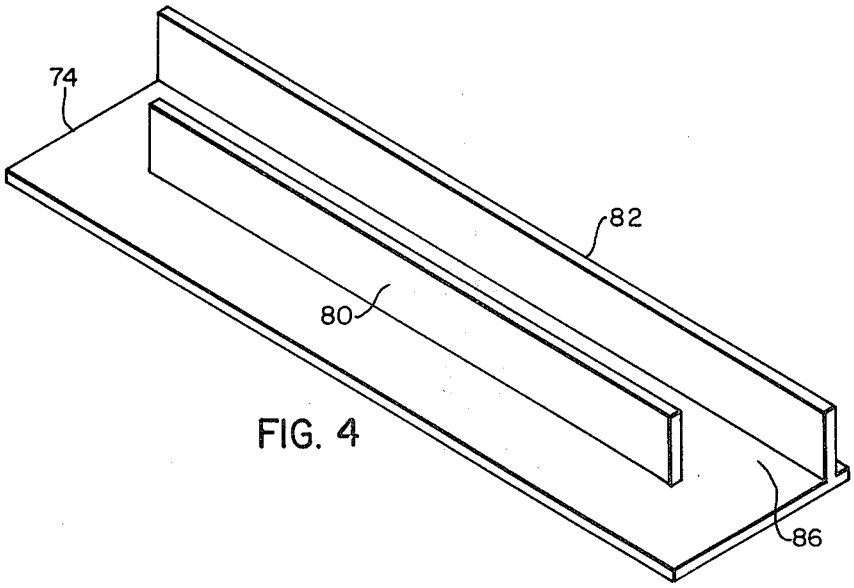

FIG. 2 is a top view of the core and coil assembly shown in FIG. 1, illustrating the location of the supporting beams 72 and 74 with respect to the magnetic cores 10, 12 and 14. FIG. 3 is a cross-sectional view taken generally along the line III—III shown in FIG. 2, and FIG. 4 is a view of the beam 74 isolated from the other portions of the transformer. By referring to FIGS. 2, 3, and 4, it can be seen that the beams 72 and 74 are located underneath the core legs 36, 38, 40, 42, 44 and 46. The web portions of the beams 72 and 74 extend into the regions between the various core legs to provide additional reinforcement for the supporting beams. The web 80 of the supporting beam 74 extends into the gap 84 which is located between the magnetic core legs 42 and 44. The web 82 of the supporting beam 74 extends into the space 86 located between the main magnetic core 10 and the shielding magnetic core 14. A similar arrangement exists for the beam 72 at the other end of the magnetic core 10.

The double-webbed structure of the supporting beams 72 and 74 increases the supporting strength of the beam flanges, such as the flange 86. The web 80 of the supporting beam 74 does not extend to the ends of the flange 86 in order that the web 80 may extend into the gap 84 in the magnetic core 10. The web 82 of the supporting beam 74 extends to the ends of the flange 86 since it is located outside of the magnetic core 10 and is not limited by the inside dimensions of the outer magnetic core portion 62.

The supporting beams 72 and 74 may be constructed of solid steel components or they may be constructed of laminated steel members in a manner which is known by those skilled in the art for reducing the heating of supporting beams located adjacent to magnetic cores. In addition, various openings or spaces in the beam members may be used to aid the flow of a liquid dielectric through the magnetic core 10.

The gap 32 may have different separation distances around the magnetic core 10 to accommodate the placement of various members of the transformer. For example, the separation distance of the gap between the core legs 38 and 40 and between the core legs 42 and 44 may be larger than the separation distance of the gap between the core yokes 52 and 54 and between the core yokes 60 and 62. Generally, the gap width between core legs is determined by the thickness of the beam web positioned therein and the gap width between the core yokes is determined by the cooling requirements.

Since numerous changes may be made in the abovedescribed apparatus, and since different embodiments of the invention may be made without departing from the spirit thereof, it is intended that all of the matter contained in the foregoing description, or shown in the accompanying drawing, shall be interpreted as illustrative rather than limiting.

We claim as our invention:

1. Electrical inductive apparatus comprising:

first, second, third and fourth rectangular magnetic structures each having first and second leg portions and first and second yoke portions constructed of stacked metallic laminations;

a winding structure inductively coupled to said magnetic structures;

said first magnetic structure being surrounded by said second magnetic structure, with said first and second magnetic structures being spaced from each other to form first and second gaps between their adjacent yoke portions and third and fourth gaps between their adjacent leg portions, with the second leg portion of the third magnetic structure located adjacent to the first leg portion of the second magnetic structure, and with the first leg portion of the fourth magnetic structure located adjacent to the second leg portion of the second magnetic structure;

an apparatus enclosure having vertical side walls which join a horizontal supporting surface;

said metallic laminations being stacked with their faces oriented perpendicular to said vertical side walls; and at least one structural member supported by the horizontal supporting surface, said structural member including a beam having a flange and two parallel web portions, with one of said web portions projecting into said third gap, and with the other of said web portions located between the first leg portion of the second magnetic structure and the second leg portion of the third magnetic structure.

2. A single-phase, shell-form power transformer comprising:

first, second, third and fourth rectangular magnetic structures each having first and second leg portions and first and second yoke portions constructed of stacked metallic laminations;

a winding structure inductively coupled to said magnetic structures;

said first magnetic structure being surrounded by said second magnetic structure, with said first and second magnetic structures being spaced from each other to form first and second gaps between their adjacent yoke portions and third and fourth gaps between their adjacent leg portions, with the second leg portion of the third magnetic structure located adjacent to the first leg portion of the second magnetic structure, and with the first leg portion of the fourth magnetic structure located adjacent to the second leg portion of the second magnetic structure;

said first and second gaps each having a smaller separation distance than the separation distance of the third and fourth gaps;

a tank having vertical side walls and a horizontal supporting surface attached to a bottom portion of said tank;

said metallic laminations being stacked with their faces oriented perpendicular to said vertical side walls; and first and second structural beams supported by said horizontal supporting surface, said beams each having a flange and two parallel web portions, with one of said web portions of the first beam projecting into the third gap, and with the other of said web portions of the first beam located between the first leg portion of the second magnetic structure and the second leg portion of the third magnetic structure, and with one of said web portions of the second beam projecting into the fourth gap, with the other of said web portions of the second beam located between the second leg portion of the second magnetic structure and the first leg portion of the fourth magnetic structure.

* * * * *